US005333399A

United States Patent [19]

Mett

[11] Patent Number: 5,333,399

[45] Date of Patent: Aug. 2, 1994

[54] FASTENING OF THE BUCKETS AND POSSIBLY ALSO THE SKIM CUTTERS ON CUTTING WHEELS

[75] Inventor: Joachim Mett, Lübeck, Fed. Rep. of Germany

[73] Assignee: O&K Orenstein & Koppel AG, Berlin, Fed. Rep. of Germany

[21] Appl. No.: 779,010

[22] PCT Filed: Nov. 17, 1990

[86] PCT No.: PCT/EP90/01969

§ 371 Date: Aug. 24, 1992

§ 102(e) Date: Aug. 24, 1992

[87] PCT Pub. No.: WO91/13219

PCT Pub. Date: Sep. 5, 1991

[30] Foreign Application Priority Data

Feb. 22, 1990 [DE] Fed. Rep. of Germany ..... 4005617

[51] Int. Cl.[5] ..... E02F 9/28; E02F 5/08

[52] U.S. Cl. ..... 37/455; 37/452; 37/446; 37/189; 37/94

[58] Field of Search ..... 37/142 R, 142 A, 141 R, 37/189, 94, 70, 446, 450, 452, 455

[56] References Cited

U.S. PATENT DOCUMENTS

| | | | |
|---|---|---|---|
| 3,481,057 | 12/1969 | Zink . | |
| 3,498,677 | 3/1970 | Morrow | 37/142 R X |
| 3,509,648 | 5/1970 | Smith | 37/142 R |
| 3,913,979 | 10/1975 | Strauss et al. | 37/142 R X |
| 3,968,580 | 7/1976 | Lombardi et al. . | |
| 4,197,662 | 4/1980 | McAulay et al. | 37/189 |
| 4,445,608 | 5/1984 | Evans et al. | 37/70 X |
| 4,768,297 | 9/1988 | Rivard . | |

FOREIGN PATENT DOCUMENTS

| | | |
|---|---|---|
| 0249551 | 12/1987 | European Pat. Off. . |
| 1145105 | 3/1963 | Fed. Rep. of Germany . |
| 2609965 | 9/1976 | Fed. Rep. of Germany . |
| 2620362 | 11/1977 | Fed. Rep. of Germany . |
| 3737893 | 6/1988 | Fed. Rep. of Germany . |
| 3736464 | 6/1989 | Fed. Rep. of Germany . |
| 3822235 | 1/1990 | Fed. Rep. of Germany . |
| 129462 | 1/1978 | German Democratic Rep. . |
| 159556 | 3/1983 | German Democratic Rep. . |
| 785514 | 10/1957 | United Kingdom . |

*Primary Examiner*—Randolph A. Reese
*Assistant Examiner*—J. Russell McBee
*Attorney, Agent, or Firm*—Spencer, Frank & Schneider

[57] ABSTRACT

A digging wheel assembly includes a supporting wheel having a peripheral zone and a plurality of receiving elements affixed to the supporting wheel in the peripheral zone in a spaced, circumferential distribution. Each receiving element has a receiving pocket and a receiving slot. Digging tool components are disposed along the peripheral zone of the supporting wheel in a circumferential distribution. Each digging tool component is disposed between two circumferentially adjoining receiving elements; one being a leading receiving element and one being a trailing receiving element as viewed in the rotary working direction of the assembly. Each digging tool component has a leading part extending from a front end of the digging tool component in the rotary working direction and being accommodated in the receiving pocket of the leading receiving element. Each digging tool component also has a trailing part extending from a rear end of the digging tool component against the rotary working direction and being accommodated in the receiving slot of the trailing receiving element. The receiving elements form a securing arrangement for removably affixing the digging tool components to the supporting wheel.

9 Claims, 1 Drawing Sheet

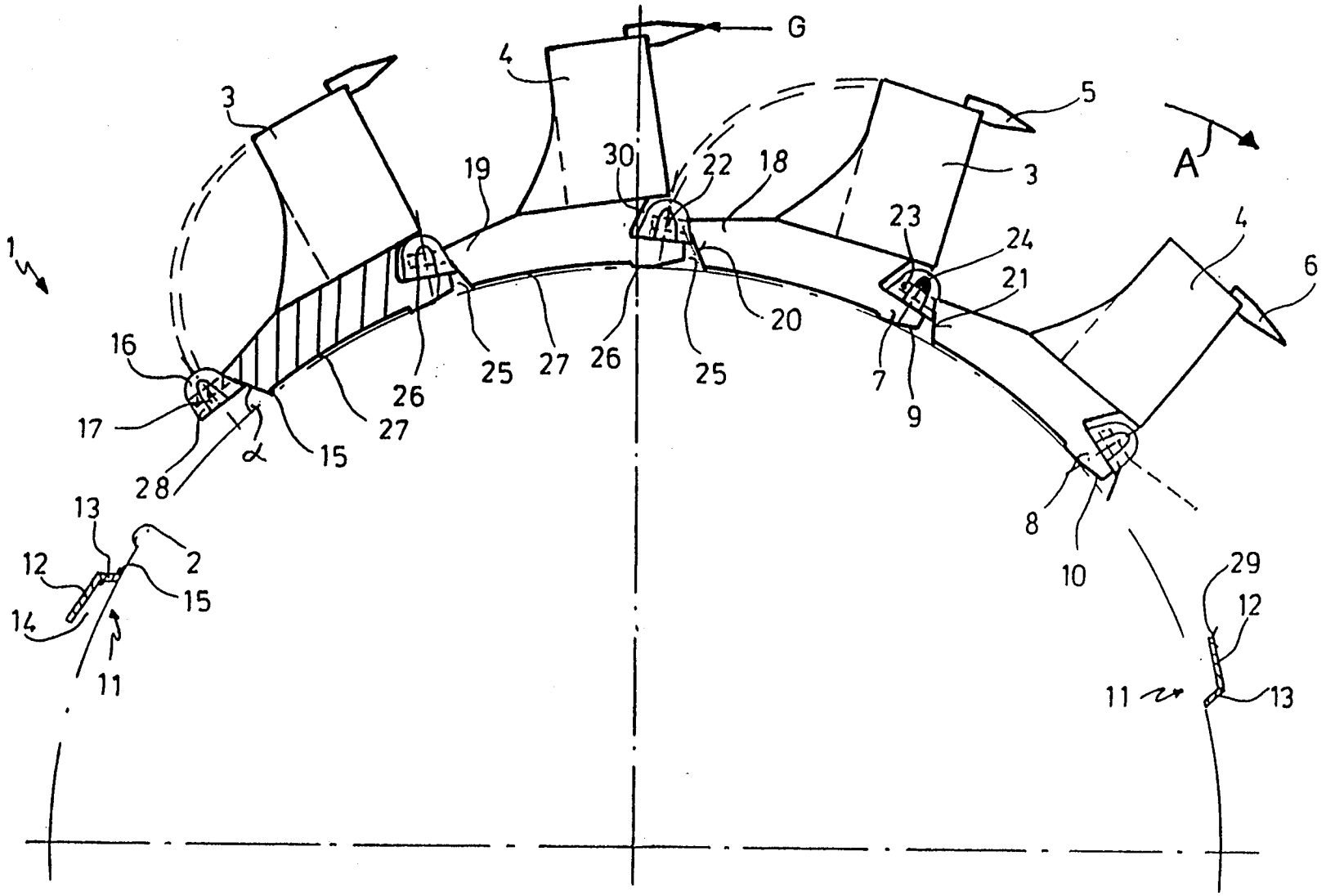
A
G
1
2
3
4
5
6
7
8
9
10
11
12
13
14
15
16
17
18
19
20
21
22
23
24
25
26
27
28
29
30
α

FASTENING OF THE BUCKETS AND POSSIBLY ALSO THE SKIM CUTTERS ON CUTTING WHEELS

BACKGROUND OF THE INVENTION

The invention relates to the fastening of the buckets and possibly also the skim cutters to cutting wheels, such as bucket wheels or under water cutting wheels, wherein the buckets and possibly also the skim cutters are exchangeably attached by way of connecting elements to the outer circumference of the cutting wheels. The buckets and skim cutters will also be generally referred to as digging tool components and the bucket wheels and cutting wheels will also be generally referred to as supporting wheels. The entire rotary structure will also be referred to as digging wheel assembly.

German Unexamined Published Patent Application 3,822,235 discloses a bucket wheel body, particularly for surface mining apparatus, which is composed of a supporting body that is rotatably mounted on the axis of the bucket wheel and is provided with a plurality of buckets that are connected with the carrier body by means of at least one ring carrier. The ring carrier is disk-shaped and, seen in the circumferential direction, is provided with two superposed approximately horizontally extending flanges that are connected with the ring carrier outside of the bucket wheel body. By means of connecting elements, the front and rear regions of the buckets provided at the ring carriers are releasably connected with the bucket wheel body.

German Unexamined Published Patent Application 3,737,893 discloses a bucket wheel bucket which has at its rear a device for preventing the buckets from being loaded with larger chunks of material (rock deflector), with the device being composed like a cage of a plurality of rods extending in the conveying direction of the bucket wheel and being disposed between the back of the preceding bucket and the next following bucket. The buckets as well as the rock deflector are fastened by way of connecting elements so that exchangeability when worn is ensured.

The drawbacks of the prior art are essentially that complicated structures must be provided on the circumference of the bucket wheel so that the buckets can be connected with it by means of the connecting elements. Such connecting elements are often formed by sleeves and pins cooperating therewith which, under certain circumstances, require much mechanical working and may deform if under certain conditions the digging forces are high so that ultimately problems arise again during the removal of the buckets. In the past, it has also been found that the reaction forces generated by the digging forces often caused the connecting elements, on the one hand, and the fastening elements, on the other hand, to break off.

SUMMARY OF THE INVENTION

It is the object of the invention to provide an improved fastening of digging tool components to the cutting (digging) wheels so that it is possible, without greater mechanical working of the fastening and/or connecting elements for the buckets and the skim cutters, to provide a simple, economical and primarily secure manner of fastening, with it being ensured that an exchange in the operating state can be effected without problems. The number of connecting elements, such as pins, sleeves or the like, should here be reduced to a minimum.

This is accomplished according to the invention in that the buckets and possibly also the skim cutters, when seen in the cutting direction, are clampable in their forward regions and supportable in their rearward region and are there arrestable by means of connecting elements.

With the combination, according to the invention, of a receiving device (socket pocket) for the forward fastening of the buckets and skim cutters with an integrated wedge fastening for the rear portion of the buckets and the skim cutters, a manner of fastening has been developed which is simple in configuration and is able to take advantage of prefabricated components which require no further working. The front, profiled regions of the buckets and of the skim cutters thus, in the course of the assembly of the buckets and skim cutters, respectively, engage in the receiving devices configured as socket pockets, with the front regions being partially supported at the outer circumference and simultaneously being provided with a slope intended for assembly and disassembly which facilitates the introduction and removal of the bucket and skim cutters, respectively. While forming a radial gap between the outer circumferential face of the cutting wheel and the bucket or the skim cutter, respectively, the rear region of the bucket or skim cutter, respectively, is supported on a sloped metal sheet of the receiving device, while the free ends of the rear regions extend between radially extending guide sheets, that are welded to the receiving elements, and form a radial gap between themselves and the receiving elements.

Due to the reaction forces generated by the digging forces, the respective bucket or the respective skim cutter will tend to overcome the radial gaps by traveling along the sloped metal sheet, thus simultaneously pressing the forward region of the bucket or of the skim cutter, respectively, deeper into the respective receiving element. The possibly adjustable wedge connection prevents the buckets or the skim cutter, respectively, from radially sliding out. The fastening means are preferably configured in such a way that the rearward region of the buckets and of the skim cutters, respectively, are supported exclusively on the associated sloped metal sheet without it happening, however, that the digging forces are able to completely close the radial gap. With this measure it is ensured that, if it is necessary to exchange the buckets or the skim cutters, respectively, a tool inserted axially into the gap will be able to push the buckets or the skim cutters, respectively, out of the receiving element by means of lever action in a direction opposite to the installation direction. The receiving elements themselves are preferably connected with the outer circumference of the cutting wheel by welding.

With this type of fastening, the previously employed bearing sleeves and pins which had to be worked relatively precisely are no longer required to fasten the buckets or skim cutters, respectively. Since the wear of the receiving elements can be considered to be negligible, it is here possible, except for an exchange of the buckets and skim cutters, respectively, to count on a long service life for the cutting wheel. Compared to the prior art fastening method, the simplification of the installation and removal process allows for a considerable saving in time and, resulting therefrom, in costs.

The subject matter of the invention can be used for any type of cutting or pick-up wheels as they are employed, for example, in surface mining, in underwater work as well as in receiving devices on stockpiles.

BRIEF DESCRIPTION OF THE DRAWING

The sole FIGURE is a fragmentary, schematic, partially sectional side elevational view of a preferred embodiment of the invention.

DESCRIPTION OF THE PREFERRED EMBODIMENT

The sole drawing FIGURE depicts a cutting wheel 1 to be used for a surface mining apparatus that is not shown in detail. Buckets 3, on the one hand, and skim cutters 4, on the other hand, are fastened to the outer circumference 2 of cutting wheel 1. The buckets 3 as well as the skim cutters 4 are equipped with cutting and digging tools 5 and 6. The front regions, seen in the cutting direction (direction of the arrow A) of buckets 3 as well as of skim cutters 4 are provided with a profile that forms projections or leading parts 7 and 8, preferably of identical configuration. Projections 7 and 8 are configured to have installation and removal slopes 9 and 10 of predetermined slope angles. The receiving elements 11 are formed of metal sheets 12 and 13 which have a pocket-shaped cross section, with sheets 12 extending approximately tangentially to cutting wheel 1 and tapering, seen from their slope, from their open region 14 toward the closing metal sheet 13. Metal sheets 13 are welded at 15 to the outer circumference 2 of cutting wheel 1 forming an acute angle $\alpha$ with the outer circumference 2 of cutting wheel 1. Thus, each metal sheet 13, as seen in the FIGURE, has an outer face which extends generally transversely to the cutting direction A. Further metal sheets 16 are welded radially onto sheets 12 and are provided with passage slots 17. The rear regions or trailing parts 18 and 19 of buckets 3 and skim cutters 4 are each provided with a likewise sloped supporting face 20, 21 which has approximately the same slope angle $\alpha$ as metal sheets 13. The end regions 22 and 23 of buckets 3 and skim cutters 4 are each guided between pairs of parallel metal sheets 16 and are secured against slipping out by means of a wedge 24.

The installation of buckets 3 and skim cutters 4, respectively, takes place approximately as follows:

The installation slope 9 is placed onto the outer circumference 2 of cutting wheel 1 and is introduced into the free space 25 of receiving elements 11 formed by sheets 12 and 13. Upon further pressing in the cutting direction (direction of arrow), regions 26 come to lie against the outer circumference 2 of cutting wheel 1, while simultaneously a supporting face 20 and 21, respectively, engages at metal sheet 13 and the free ends 22 and 23, respectively, extend between sheets 16. While forming radial gaps 27 and 28, on the one hand, between the outer circumference 2 of cutting wheel 1 and bucket 3 and, on the other hand, between metal sheet 12 and the end regions 22 and 23, respectively, bucket 3 and skim cutter 4, respectively, are pressed into the free space 25 to such an extent that optimum clamping is ensured. A gap 30 likewise remains between the end faces 29 of metal sheets 12 and the associated bucket 3 and the associated skim cutter 4, respectively. Due to the digging forces G occurring during cutting at cutting tools 5 and 6, respectively, a reaction force is built up which tends to press projections 7 and 8, respectively, deeper into receiving elements 11, thus inevitably also reducing the radial gaps 27 and 28 and the circumferential gap 30, respectively. The individual components are adapted to one another in such a way that a radial gap 27 or 28, respectively, remains even at a high digging force G so that during removal a tool that is not shown here is able to engage in them and lever out the respective bucket or the respective skim cutter along sheet 13. The levering out is supported by the removal slopes 9 and 10, respectively.

I claim:

1. A digging wheel assembly comprising (a) a supporting wheel having a peripheral zone and a rotary working direction;

(b) a plurality of receiving elements affixed to said supporting wheel in said peripheral zone in a spaced, circumferential distribution; each said receiving element including means for defining a receiving pocket and a receiving slot;

(c) a plurality of digging tool components disposed along the peripheral zone of said supporting wheel in a circumferential distribution; each said digging tool component being disposed between two circumferentially adjoining said receiving elements; one of said two adjoining receiving elements being a leading receiving element and one of said two adjoining receiving elements being a trailing receiving element as viewed in said rotary working direction; each said digging tool component including (1) a leading part extending from a front end of the digging tool component in said rotary working direction and being accommodated in the receiving pocket of said leading receiving element; and (2) a trailing part extending from a rear end of said digging tool component against said rotary working direction and being accommodated in said receiving slot of said trailing receiving element; said receiving elements forming securing means for removably affixing said digging tool components to said supporting wheel.

2. The digging wheel assembly as defined in claim 1, wherein said digging tool components comprise buckets.

3. The digging wheel assembly as defined in claim 1, wherein said digging tool components comprise skim cutters.

4. The digging wheel assembly as defined in claim 1, wherein each said receiving element comprises a sheet metal component affixed to said supporting wheel in said peripheral zone thereof; said sheet metal member defining said receiving pocket; said receiving pocket having a closed end and an opposite, open end; said open end being oriented opposite said rotary working direction; said receiving pocket widening in a direction from said closed end towards said open end.

5. The digging wheel assembly as defined in claim 4, wherein each said sheet metal member has an outer face oriented generally transversely to said rotary working direction and further wherein said trailing part of each said digging tool component has a supporting face being in a face-to-face abutting relationship with the outer face of a respective said sheet metal member.

6. The digging wheel assembly as defined in claim 4, wherein said means for defining a receiving slot includes a pair of face-to-face oriented, spaced sheet metal members affixed to said sheet metal component of each said receiving element.

7. The digging wheel assembly as defined in claim 1, wherein said leading part of each said digging tool component has an underface oriented towards a peripheral surface of said supporting wheel and sloping away therefrom in said rotary working direction.

8. The digging wheel assembly as defined in claim 1, further comprising a connecting element disposed in each said receiving slot for restraining displacement of the trailing part accommodated in the receiving slot and belonging to respective said digging tool components.

9. The digging wheel assembly as defined in claim 8, wherein said connecting element comprises a wedge.

* * * * *